United States Patent [19]

Kenny

[11] Patent Number: 4,619,218

[45] Date of Patent: Oct. 28, 1986

[54] EMBEDMENT ANCHOR

[75] Inventor: Patrick M. Kenny, Belle Chasse, La.

[73] Assignee: Hen-Jac, Inc., Belle Chasse, La.

[21] Appl. No.: 574,871

[22] Filed: Jan. 30, 1984

[51] Int. Cl.[4] ..... B63B 21/28

[52] U.S. Cl. ..... 114/295

[58] Field of Search ..... 114/295; 175/6; 52/158; 89/1.1, 1.14; 405/228

[56] References Cited

U.S. PATENT DOCUMENTS

| | | | |
|---|---|---|---|
| 2,583,965 | 1/1952 | Page, Jr. et al. | 175/6 |
| 3,032,000 | 5/1962 | Feiler | 114/295 |
| 3,170,433 | 2/1965 | Gardiner | 114/295 |

*Primary Examiner*—Sherman D. Basinger
*Attorney, Agent, or Firm*—Keaty & Keaty

[57] ABSTRACT

An improved, explosively embedded anchor assembly for use in sedimentary strata and similarly nonconsolidated or rocky ocean bottom surfaces is shown. The anchor comprises an inertially loaded reaction member above a substantially elongated anchor shaft, coaxially positioned around an elongated drive tube assembly. The anchor shaft has a number of open cross-section triangular sheet metal anchoring fins, providing substantially low resistance to penetration within the strata, but providing substantially high resistance to sideways displacement forces, as would be imposed through a standard anchor rode. The anchor is positioned by lowering the inertial reaction unit and embedded by the weight of the inertial reaction unit a distance into the surface layer of the subocean strata. An internal detonator control assures vertical embedment unless the anchor is vertically positioned. The anchor is remotely fired after initial embedment.

6 Claims, 5 Drawing Figures

EMBEDMENT ANCHOR

BACKGROUND OF THE INVENTION

This invention relates to the field of explosively embedded anchoring or mooring devices for providing a mooring or anchoring point on the surface of the sea or ocean floor.

Actively embedded anchors are known to the art and, with few exceptions, all comprise variants on the same basic structure. A penetrating shaped anchor member having some form of sea bed contact firing mechanism is connected to a dynamic reaction unit which provides a substantial resistance by means of hydrodynamic coupling to the ocean water. The anchors contain a relatively high velocity, high explosive component which is fired by contact of the tip of the anchor with the ocean floor. The high explosive detonation drives the anchoring tip into the ocean floor. The reaction forces are coupled to the reaction member and are then hydrodynamically coupled to the ocean.

Typical examples include Feiler U.S. Pat. No. 3,032,000 showing an early form of a penetrator head having contact detonation and a described light weight dynamic reaction member. Gardiner U.S. Pat. No. 3,170,433 introduces the use of anchoring fins on the penetration member. Bower U.S. Pat. No. 3,520,268 shows an elaborate gas seal for coupling the high velocity gas expansion into the penetrator head and shows the current state of the art in light weight water resisting reaction members.

An alternate development has been development of a series of explosively embedded, expanding plate anchors. Typical are Christians et al U.S. Pat. No. 3,653,355; Mayo, U.S. Pat. No. 3,731,646; and Stern et al, U.S. Pat. No. 4,356,788, each of which show expanding fluke structures which are explosively embedded into an ocean floor and which expand upon attempted withdrawal, resisting essentially vertical forces.

Variant self-bury anchors include Hossfeld, U.S. Pat. No. 4,347,802, which shows an adaptation of the jet wash principle to dynamically embed an anchor member by the use of a directed stream of fluid washing an embedment hole within the subocean floor. Brown, U.S. Pat. No. 3,517,469 shows the use of an expanding, explosive camouflet to expand of the tip of an explosively embedded anchor to more securely fasten it to the ocean floor.

SUMMARY OF THE INVENTION

An improved explosively embedded anchor assembly is shown having special utility for use for precision anchorages, such as are required in the oil drilling industry where an oil rig is moored at sea to a precise location for drilling purposes. The anchor is designed specifically for mooring within sedimentary strata, although it will function in most sea bottom structures not comprising consolidated rock.

The anchor of the instant invention is intended to provide an apparatus permitting both accurate positioning of the embedded anchor as well as providing a stronger and more resistent mooring or anchoring base than heretofore has been possible with explosively embedded anchors. It incorporates a substantially longer anchor spear than has been possible with the prior art. It couples this with embedding means to insure that the elongated anchor spear is embedded in a substantially vertical position deep in the strata so as to provide the maximum resistence to withdrawal from an anchor rode of proper scope. The resulting mooring is capable of securing large floating structures such as drill platforms in heavy storm seas. The overall resistance of the resulting anchoring or mooring structure is substantially greater than that provided by the embedded anchors of the prior art.

It is thus an object of this invention to provide an embedded anchoring means capable of withstanding greater withdrawal forces than heretofore has been possible.

It is a further object of this invention to provide an embedded anchoring means capable of imbedding a substantially larger anchor than heretofore has been possible.

It is a further object of this invention to provide an embedded anchoring means which ensures that the embedded anchor is embedded in a substantially deeper vertical position, having thereby maximal resistance to withdrawal forces from an anchor rode.

These and other objects and advantages of the instant invention will be more clear from the detailed description of the preferred embodiment which follows.

DETAILED DESCRIPTION OF THE PREFERRED EMBODIMENT

Figure 1:
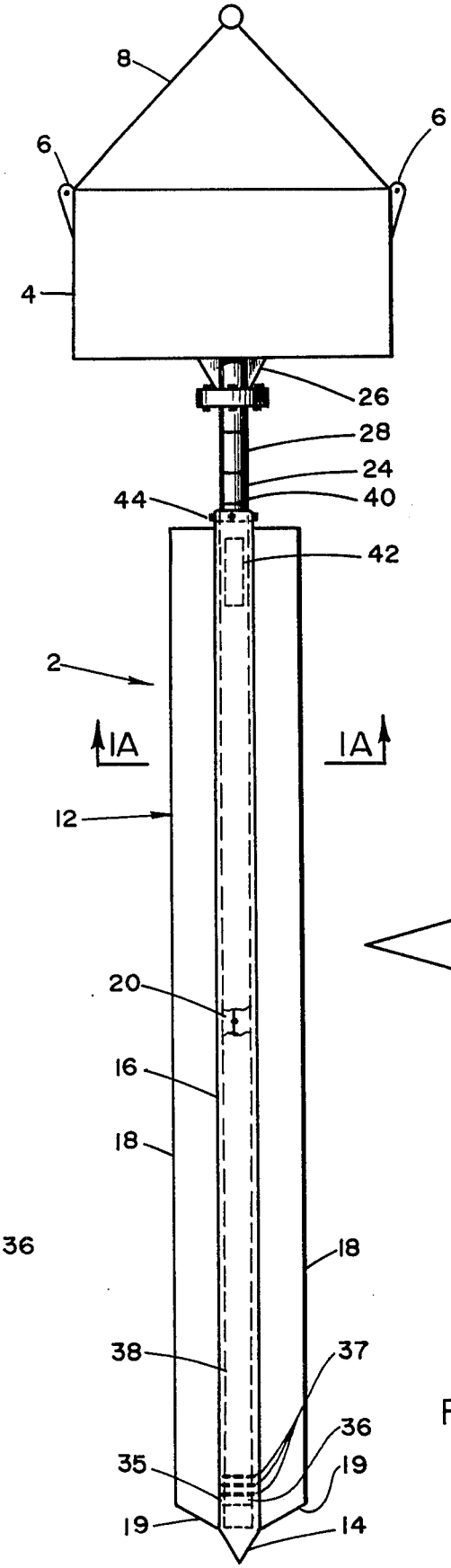
FIG. 1 is a side view of overall embedment assembly in the unfired position.
Figure 1A:
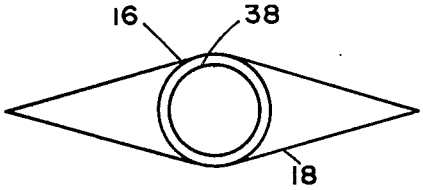
FIG. 1A is a cross-sectional view of anchor spear taken along lines 1A—1A of FIG. 1.
Figure 1B:
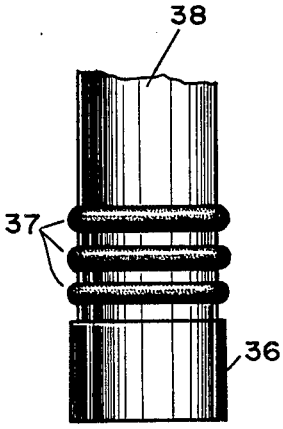
FIG. 1B is a partial, cutaway view of drive tube showing in detail sealing means of the apparatus of the present invention.

FIG. 1 shows the overall explosive anchor assembly 2. The explosive assembly 2 is seen to comprise an essentially vertical assembly having at its top a drive weight 4 which comprises a substantially heavy structure. In the preferred embodiment, this is a structure comprising primarily a reinforced concrete slab having either a cylindrical or a rectangular structure. At upper corners of the drive weight 4 are found a plurality of drive weight mooring points 6 to which is attached a drive weight suspension harness 8 permitting the entire explosive anchor 2 to be raised, lowered, or otherwise manipulated by standard crane or lifting means, not shown, attached to the drive weight suspension harness 8.

Extending vertically down from the drive weight 4, centered therefrom, may be seen an assemblage comprising an anchor spear 12 of substantially elongated shape which is coaxially mounted upon a drive tube assembly 24 vertically extending downward from drive weight 4, connected thereto by a flange subassembly 28. Anchor spear 12, as mentioned, is coaxially installed about drive tube assembly 24, and is secured thereto by a sheer bolt assembly 44, comprising a plurality of shear bolts, circumferentially equidistantly disposed about drive tube assembly 24, and which are designed to shear when a downward force moves the anchor spear into the soil.

Anchor spear 12 in turn comprises an essentially elongated metal assembly. In the preferred embodiment of the explosive anchors, spear 12 is in excess of eighteen feet long although lengths as short as six feet are acceptable. Anchor spear 12 terminates at a bottom deflection point 14, which in turn forms a closed end to an elongated sleeve shaft body 16 which sealingly encloses the drive tube assembly 24. Radially extending outward from the sleeve shaft 16 are a plurality of penetrator fins 18. In the preferred embodiment, penetrator fins 18 are of a hollow, triangular cross section formed of a mild steel sheet. Penetrator fins 18 further have an angled lower entry face 19 which is open to the interior hollow triangular shape of the penetrator fins 18. The penetrator fins 18 extend in a smoothly vertically attached manner for the length of the sleeve shaft body 16 from a point adjacent to the penetration point 14 vertically to a point adjacent to the top of the sleeve shaft body 16. At a point on the sleeve shaft body 16 adjacent to the mid-point of the shaft body 16, is found an anchor mooring point 20 for connecting to an anchor rode 46.

Extending within the length of the sleeve shaft body 16 is the drive tube assembly 24. Drive tube assembly 24 extends from a weight base 26 embedded within weight 4, and extends downwards, connecting through a flange subassembly 28 to explosive drive tube 38, all in a manner such that the overall drive tube assembly 24 is both centered and extends in a vertical direct downward when the drive weight 4 is suspended by the drive weight suspension harness 8 in a hanging condition.

Figure 2:
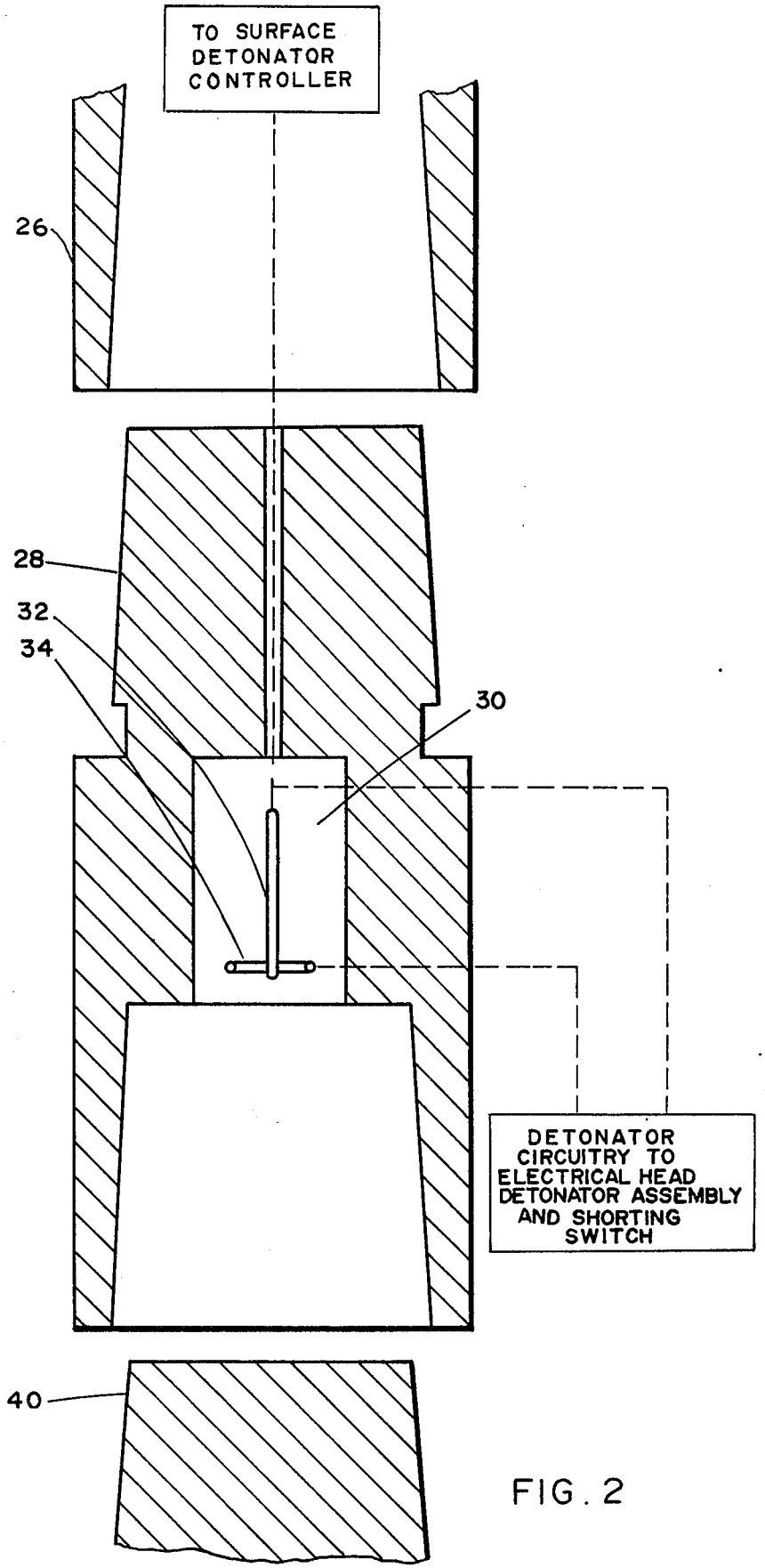
FIG. 2 is an exploded view of an embodiment with a vertical position sensor means for controlling firing.
Figure 3:
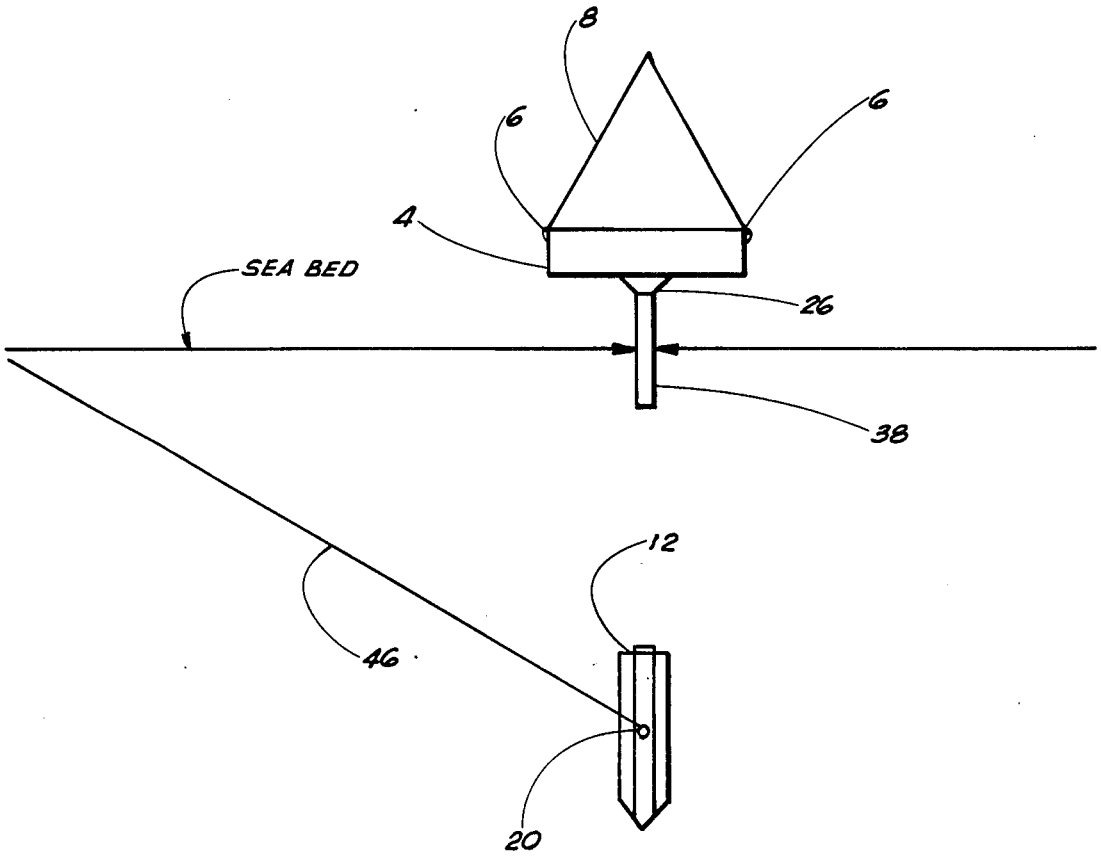
FIG. 3 is a side section view of the embedded anchor.

Flange subassembly 28 is shown in FIG. 2 to further contain vertical position sensing means 30. Vertical position sensing means 30 in a preferred embodiment comprises an electrically conductive pendulum 32, axially suspended, freely adapted for swinging, within electrical shorting ring 34. Flange subassembly 28 is sealingly connected to drive tube 38 such that pendulum 32 and shorting ring 34 are isolated from the underwater environment and remain substantially dry.

Drive tube 38 extends downward from flange subassembly 28 coaxially within sleeve shaft body 16 of the anchor spear 12. Within drive tube 38 is found an electrical head detonator assembly 40 adapted for electrical detonation of gas generator explosive 42. It is a particular part of this invention that the gas generator explosive 42 disposed within the upper end of the drive tube 38 is a relatively low velocity explosive. In a preferred embodiment, explosiver 42 is Black Powder. The head detonator assembly 40 is an electrical detonator of standard underwater design. The head detonator assembly 40 is electrically connected in parallel with an electrical switch means formed by the pendulum 32 and the shorting ring 34 in a manner hereinafter explained. The head detonator assembly 40 is electrically connected in a manner well known to the art, not shown, axially through the drive tube 38 of flange subassembly 28, the weight base 26 and the drive weight 4 with connection wires raised up adjacently to the drive weight suspension harness 8 to a surface detonation controller.

Annularly installed about the lower exterior end of the drive tube 38 sealingly contacting the drive tube 38 and the interior of the sleeve shaft body 16 is sealing means 35. Sealing means 35 comprises Brass sealing sleeve 36, contactingly sealing that lower annulus region to be found between tube 38 and spear shaft body 16, adjacent the lower end of tube 38. Sealing means further comprises O-ring seals 37, sealingly, slipably found immediately above Brass sleeve 36. Sealing means 36 forms an essentially gas and water tight seal, adapted for sliding, at the lower conjunctive end of drive tube 38 and sleeve shaft body 16. Seal means 35 both secures explosive 42 in a dry state underwater, and seals the explosive gas within tube 38 and shaft 16 during airing.

In operation, the entire explosive anchor 2 is lowered through the sea by means of a crane or the like connected to the drive weight suspension harness 8. The overall geometry of the drive weight suspension harness 8 and the substantial length and weight of the anchor spear 12 cause the anchor spear 12 to remain in an essentially vertical position as the explosive anchor 2 is lowered.

The explosive anchor 2 is lowered until the deflection point 14 contacts the sea bed floor. The combined effect of the weight of the drive weight 4, the shape of the deflection point 14, and the angled, essentially open shape of the lower entry faces 19 of the penetrator fins 18 cause the anchor spear 12 to be driven by weight and impact, a substantial distance into the sea bed floor. It is found sufficient that there is at least three feet of penetration.

If the penetration has occurred in a substantially vertical direction; that is, if there has been no deflection of the anchor speer 12 as it penetrates the sea floor, then pendulum 32 will remain suspended axially within shorting ring 34, without making electrical contact therewith, and thereby will not cause the vertical position sensing means 30 to short out the electrical circuit to the head detonator assembly 40.

Upon determination that the anchor 2 has embedded itself partially within the sea floor, as would be apparent from a slacking of the cable attached to the drive weight suspension harness 8, the surface detonation control device means are activated. Provided that the vertical position sensing means 30 has not, in the manner of a safety switch, shorted out the electrical firing circuitry to the head detonator assembly 40, the head detonator assembly 40 is activated detonating the gas generation explosive 42 within the drive tube 38. The gas generator explosive 42 occupies only a top portion of the drive tube 38 adjacent to the head detonator assembly 40. A controlled, relatively low velocity explosive shock wave thereby builds up within drive tube 38 for driving downwards against anchor spear 12 and reacting upwards against drive weight 4. The substantial inertial effects of drive weight 4 cause it to resist the relatively lower impact velocities of the slow burning gas generator exlosive 42. The substantially flat top surface aspect of the drive weight 4 introduces a degree of hydrodynamic reaction against the forces exerted by the gas generator explosive 42. It is to be noted that the lower velocity explosive, coupled with the relatively longer period application of drive forces in comparison with prior art devices would render a pure hydrodynamic reaction means ineffective.

The initial force of the detonation as applied against the anchor spear 12 and in reaction against the drive tube assembly 24 shears the shear bolt assembly 44, freeing the anchor spear 12. The sealing means 35 provides a continuing gas tight seal between the anchor spear 12 and the drive tube 38, causing the continued force of the gas generator explosive's 42 detonation to apply against the anchor spear 12 during the entire time of the anchor spear's 12 travel down the drive tube 38. In the preferred embodiment of the invention, anchor spear 12 overlaps the drive tube 38 for a distance in excess of 18 feet. As is recalled, the effects of the drive weight 4 have already embedded the anchor spear 12 a distance into the sea floor. The continued, relatively long period driving force of the explosive 42 against the anchor spear 12 continues to drive the anchor spear 12 in a vertical direction until the anchor spear 12 is substantially embedded approximately one to one and one-half times its length below the sea bed level. The deflection point 14 acts throughout to deflect spear 12 if it should contact rocks or other obstacles, without slowing spear 12.

The anchor spear 12 thus is in a nearly vertical position, extending within the sea bed, for a continuous, essentially long distance established by the overall length of the anchor spear 12 and the amount of overlap of the anchor spear 12 and the drive tube 38. The anchor rode 36, as is well known in the art of anchoring, develops an essentially horizontal scope 48 as it extends away from the anchor mooring point 20 on a midpont of the anchor spear 12. Thus forces exerted against the overall embedded anchor spear 12 are essentially horizontal. The overall embedded depth of the anchor spear 12 and the resistence against sideways motion of the vertically extending penetrator fins 18, combine to produce a substantial lever arm against the horizontal forces of the anchor rope 46, thereby providing a substantially strong mooring point.

In practice it has been found that a single anchor spear of 18 foot, 8 inches in length embedded at a depth of 26 feet secured a barge of 7000 tons displacement during a storm of force 8 where there were winds in excess of 75 knots and waves in excess of 20 feet.

It can thus be seen that the described invention is capable of producing an embedded anchor of substantially greater strength and resistance to anchoring forces then is heretofore been possible in the field embedment anchors. It is a material part of this invention that the anchor spear is embedded in a substantially vertical direction so as to provide maximum resistance to the generally horizontal forces of the anchor rode 46. It is of equal importance that the anchor spear 12 is of a substantially greater vertical length than heretofore has been found within the sphere of embedment anchors. It is found that the combination of the substantially low velocity explosive gas generation of explosive 42 in combination with the relatively extended drive time provided by the coaxially mating lengths of the drive tube 38 of the anchor spear 12, all as sealed by the sealing means 35, provides a capability of driving the anchor spear 12 through its entire length into the subsea floor strata. This is in distinction to the earlier high velocity anchors known to the art which have a limited penetration capability, and which therefore require various articulated displacement devices to resist withdrawing forces imposed by the anchor rodes 46.

It can thus be seen that the anchor of the present invention encompasses a wider variety of equivalents than the specific preferred embodiment described above; the invention therefore includes those equivalents as claimed.

What is claimed is:

1. An embedment anchor for providing a mooring point embedded within a sea floor comprising:

a. a substantially heavy drive weight member:

b. a substantially elongated hollow drive tube assembly, extending vertically downward from said drive weight member;

c. a substantially elongated anchor spear coaxially, sealingly mounted about said drive tube member;

d. anchor rode attaching means connected to an upper point on said anchor spear;

e. low velocity explosive means within said drive tube assembly;

f. controllable detonation means adapted to detonating said explosive within said drive tube assembly; and g. vertical position sensing means, adapted to detecting a tilt away from vertical of said anchor spear, adapted to preventing detonation of said explosive upon detection of said tilt away from vertical.

2. An apparatus as described in claim 1, wherein said sealing mount further comprises:

a. a plurality of shear bolts affixing an upper end of said anchor spear to a point adjacent an upper end of said drive tube assembly; and b. sliding, gas and water sealing means annularly sealing a lower end of said drive tube within a lower end of said anchor spear assembly.

3. An apparatus as described in claim 1, wherein said anchor spear assembly further comprises:

a. a substantially elongated hollow shaft body having a sealed lower end;

b. a substantially angled deflection point extending downward from said lower end;

c. a plurality of vertical penetrator fins radially extending from said shaft.

4. An apparatus as described in claim 3, wherein said penetrator fins further comprise:

a. an essentially hollow, vertically ascending, cross-sectionally triangular sheet structure, having a closed apex, and an open base, said base affixed to said shaft; and b. an open, angled lower entry face adjacent said deflector point, angled vertically away from said deflector point.

5. An apparatus as described in claim 4, wherein said elongated hollow shaft body is at least six feet long.

6. An apparatus as described in claim 1, wherein said vertical position sensing means further comprises:

a. a gravitationally sensitive, electrically conductive pendulum means;

b. an electrically conductive shorting ring positioned in circumferentiallly surrounding spaced relationship to said pendulum means; and i. wherein said pendulum means is connected to a first electrical circuit of said detonator assembly;

ii. wherein said shorting ring means is connected to a second electrical circuit of said detonator assembly;

iii. wherein said sensing means further comprises an electrically shorting switch, adapted to disabling said detonator assembly from electrical firing.

* * * * *